US006073780A

United States Patent [19]

Fuchs

[11] Patent Number: 6,073,780

[45] Date of Patent: Jun. 13, 2000

[54] ARRANGEMENT FOR DISPLAYING STUDY AIDS WITH TEXTBOOKS

[76] Inventor: Carl M. Fuchs, 1047 Tullo Farm Rd., Bridgewater, N.J. 08807

[21] Appl. No.: 09/362,846

[22] Filed: Jul. 28, 1999

[51] Int. Cl.[7] ..... A47F 7/00

[52] U.S. Cl. ..... 211/42; 211/49.1; 248/346.01

[58] Field of Search ..... 211/42, 41.12, 211/43, 49.1, 41.1, 40; 248/346.01

[56] References Cited

U.S. PATENT DOCUMENTS 1,592,022 7/1926 Harper .
2,843,439 7/1958 Parker .
3,464,565 9/1969 Nevai ..... 211/42
4,074,451 2/1978 Jacobson et al. ..... 211/42 X
4,993,558 2/1991 Assael ..... 211/40
5,595,312 1/1997 Dardashti ..... 211/40 X

*Primary Examiner*—Robert W Gibson, Jr.
*Attorney, Agent, or Firm*—Max Fogiel

[57] ABSTRACT

An arrangement for displaying study aids together with textbooks, in which a horizontal supporting plate is mounted on vertical supporting plates or struts. A plurality of textbooks are stacked on the horizontal plate and are relevant to a specific field of knowledge to be learned by students. A plurality of study aids are located beneath the horizontal plate and within a volume defined by the horizontal plate as well as the vertical struts. The study aids are visible simultaneously with the textbooks to an onlooker when removing a textbook from the stack resting on the horizontal plate.

20 Claims, 6 Drawing Sheets

ARRANGEMENT FOR DISPLAYING STUDY AIDS WITH TEXTBOOKS

BACKGROUND OF THE INVENTION

In the use of textbooks to learn the subject matter of a specific field of knowledge, students often find that they need additional help to understand the material that is presented in the textbooks.

For example, textbooks currently available will usually explain a given principle in a few pages written by a professional who has an insight in the subject matter that is not shared by students. The explanations are often written in an abstract manner which leaves the students confused as to the application of the principles. The explanations given are not sufficiently detailed and extensive to make the student aware of the wide range of applications and different aspects of the principle being studied. The numerous possible variations of principles and their applications are usually not discussed, and it is left for the students to discover these for themselves while doing exercises. Accordingly, the average student is expected to rediscover that which has been long known and practiced, but not published or explained extensively.

In textbooks the examples usually following the explanation of a topic are too few in number and too simple to enable the student to obtain a thorough grasp of the principles involved. The explanations do not provide sufficient basis to enable a student to solve problems that may be subsequently assigned for homework or given on examinations.

The examples are presented in abbreviated form which leaves out much material between steps, and requires that students derive the omitted material themselves. As a result, students find the examples difficult to understand—contrary to the purpose of the examples.

Examples, are furthermore, often worded in a confusing manner. They do not state the problem and then present the solution. Instead, they pass through a general discussion, never revealing what is to be solved for.

Examples, also, do not always include diagrams/graphs, wherever appropriate, and students do not obtain the training to draw diagrams or graphs to simplify and organize their thinking.

Students can learn the subject only by doing the exercises themselves and reviewing them in class, to obtain experience in applying the principles with their different ramifications.

When reviewing the exercises in classrooms, instructors usually request students to take turns in writing solutions on the boards and explaining them to the class. Students often find it difficult to explain in a manner that holds the interest of the class, and enables the remaining students to follow the material written on the boards. The remaining students seated in the class are, furthermore, too occupied with copying the material from the boards, to listen to the oral explanations and concentrate on the methods of solution.

From the preceding conditions faced by students, it is understandable that students will often require study aids to supplement the class materials, usually in the form of textbooks, in order to help them understand the subject matter to be learned.

Study aids are often in the form of booklets which summarize the essential facts and theorems dealt with in a textbook. Study aids can also be in the form of problem solving books which contain a large number of solved problems dealing with the various topics presented in the textbook. Other study aids are in the form of laminated charts which provide a quick review for summary of the important materials in the textbook.

Heretofore, however, such study aids were usually found at locations quite remote from the textbooks for which the study aids were intended. For example, the textbooks may be stored on one floor of a bookstore, whereas the study aids could be stored on another floor or in the basement of the bookstore building.

As a result, students were often unaware of the availability of study aids that could be used in conjunction with their textbooks to learn the subject matter more effectively.

SUMMARY OF THE INVENTION

Accordingly, it is an object of the present invention to provide an arrangement for displaying study aids directly with textbooks, so that students can avail themselves of the study aids at the time that they pick a textbook from a stack of textbooks to purchase for a class.

Another object of the present invention is to provide a display arrangement that is simple in construction, economical to fabricate, and is compact so that it requires little space in a bookstore.

A further object of the present invention is to provide a display arrangement of study aids in conjunction with textbooks, that makes it unnecessary for students to go through study aids in different subjects before finding the study aids that are of their interest.

DESCRIPTION OF THE PREFERRED EMBODIMENTS

Figure 1:
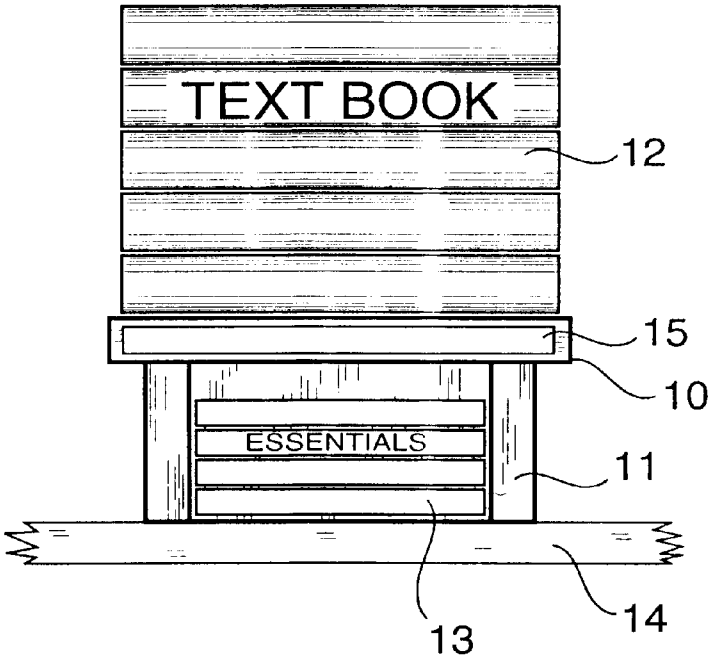
FIG. 1 is an elevational front view and shows an arrangement of textbooks with study aids in the form of booklets, in accordance with the present invention.

Referring to the drawings, FIG. 1 shows a holder for the study aids and textbook arrangement, in which the holder has a horizontal plate-shaped member 10 and two vertical plate-shaped members or struts 11. Support ed by the member 10 are a plurality of textbooks 12 resting on the member 10.

Confined by the vertical members 11, are a plurality of booklets 13, each of which summarize the subject matter presented in the textbooks. Thus, the booklets 13 contain the essentials described in the textbooks. The vertical members 11 rest on a base member 14 which may be in the form of a shelf in a bookstore, for example.

At the front side of the member 10, there is mounted a sign 15 providing a description of the study aids.

Figure 2:
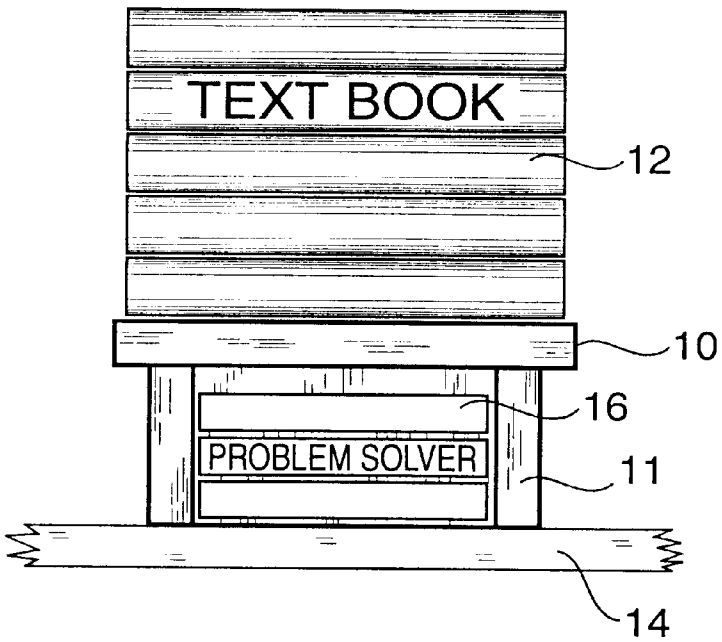
FIG. 2 is another embodiment of FIG. 1 and shows study aids in the form of books that are substantially as thick as the textbooks.

In FIG. 2 the booklets 13 are replaced by substantially heavier books 16 which contain numerous solved problems to enable students to understand better the subject matter presented in the textbooks.

Figure 3:
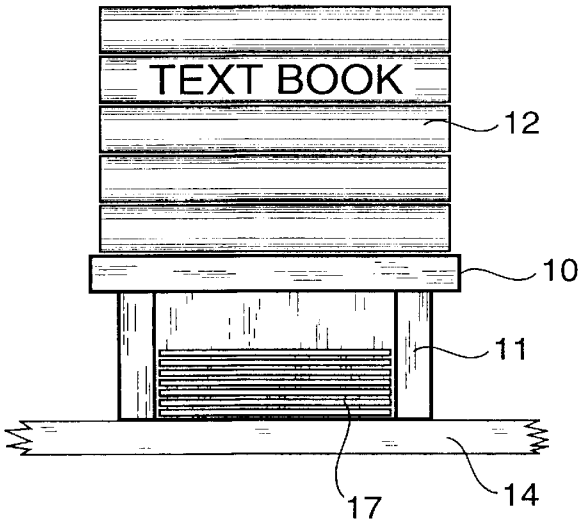
FIG. 3 is a further embodiment of FIG. 1 and shows study aids in the form of laminated charts.

FIG. 3 shows an embodiment in which laminated charts 17 are used as study aids instead of the booklets 13. These laminated charts serve to also summarize the subject matter of the textbooks. A stack of laminated charts can be used together with a stack of booklets 13 within the confines of the vertical members 11. Thus, the open space defined by the vertical members 11 and the horizontal member 10 can be used to store or hold partly the laminated chart 17 and partly the booklets 13, one on top of the other.

Figure 4:
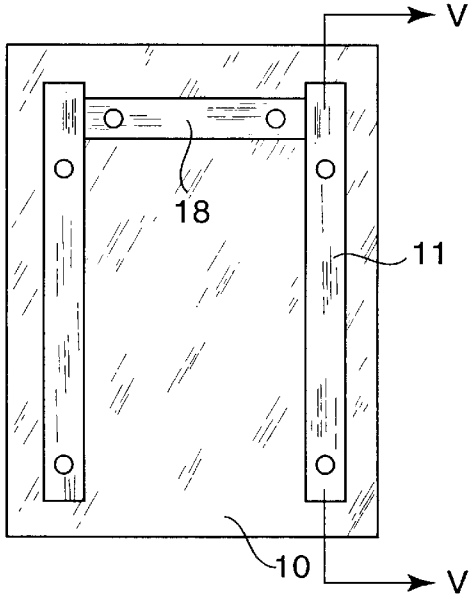
FIG. 4 is a bottom view of a holder for the study aids.
Figure 5:
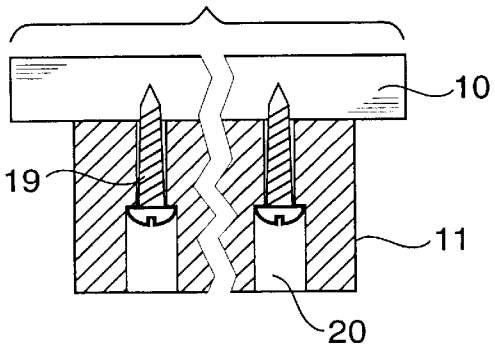
FIG. 5 is a sectional view taken along line A—A in FIG. 4.

FIG. 4 shows the study aids holder when viewed from the bottom. In addition to the vertical members 11, is a third vertical member 18 at the back side of the holder. This vertical member 18 prevents the study aids that are inserted through the front of the holder, from dropping out at the back of the holder.

The vertical members 11 and 18 can be secured to the horizontal member 10 through screws 19 pas sing into openings 20 that may be in the form of counter bores. At the same time, the member 10 can also be glued onto the vertical members 11 and 18, or a similar adhesive may be used for this purpose.

Figure 6:
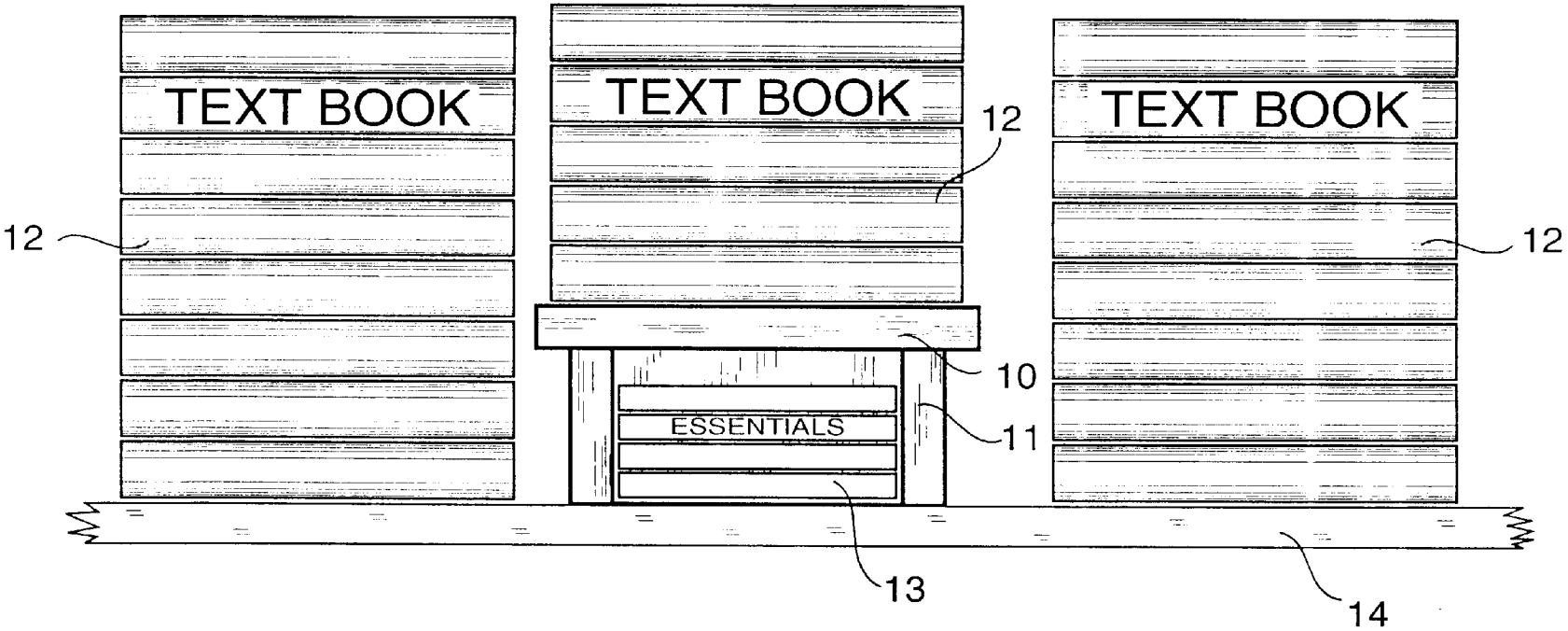
FIG. 6 is a further embodiment of FIG. 1 and shows an arrangement with the placement of additional textbooks.

FIG. 6 is display arrangement in which stacks of textbooks are located on both sides of the holder for the study aids. Thus, the study aids are located between stacks of textbooks 12 on both sides of the holder, in addition to a stack of textbooks resting on top of the holder and supported by the member 10.

Figure 7:
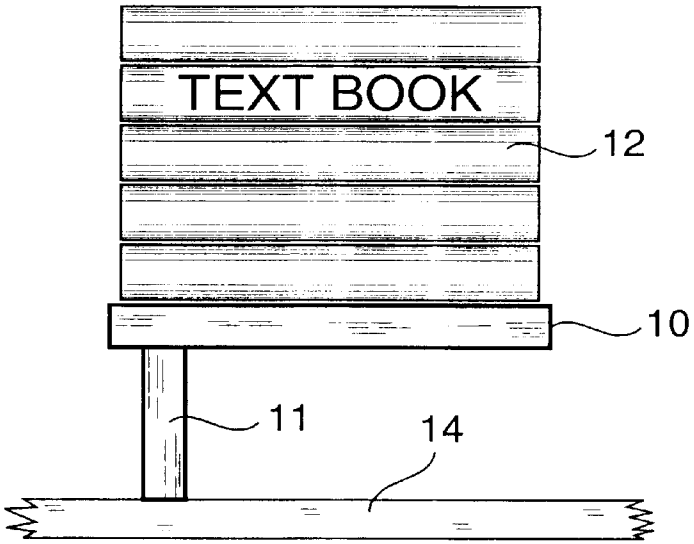
FIG. 7 is a front view of another embodiment of the holder for study aids, as shown in FIG. 1.

FIG. 7 illustrates a holder for the study aids, in which the member 10 is cantilevered on the vertical member 11. In this arrangement, only one vertical member 11 is needed. The vertical member 11 is, in turn, secured to the base member 14 at the bottom end of the member 11.

Figure 8:
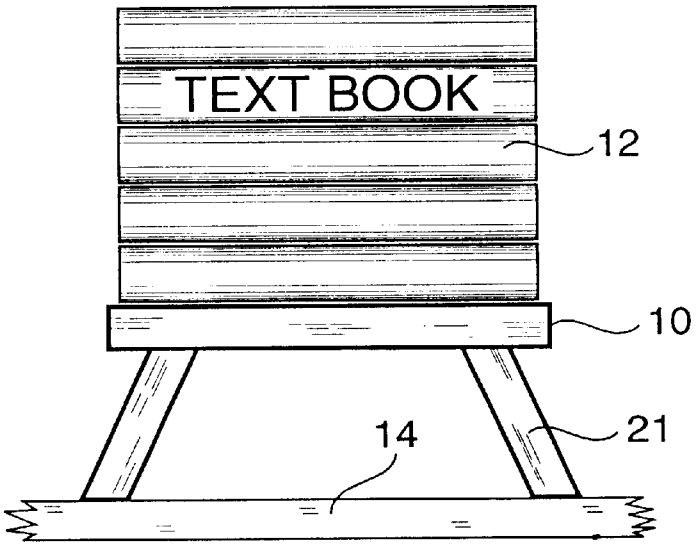
FIGS. 8, 9, 10, and 11 are front views of still further embodiments of the holder for the study aids.

FIG. 8 shows a configuration in which the members 21 supporting the horizontal plate-shaped member 10 are at an angle with respect to the member 10, as well as to the base member 14.

Figure 9:
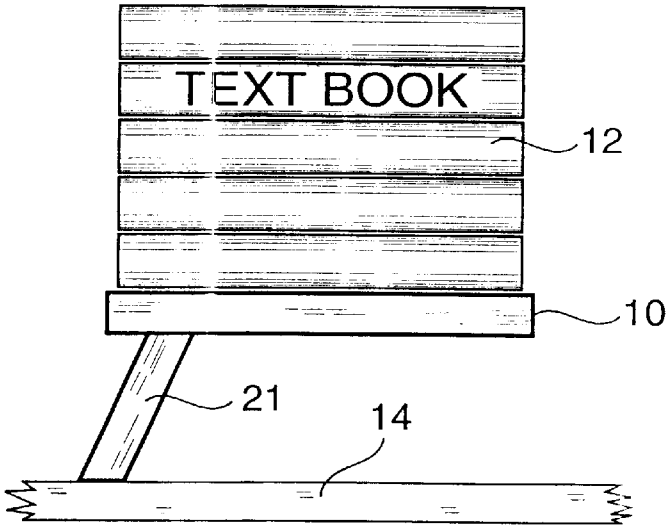

FIG. 9 is a display configuration for the study aids in which only one member 21 is used and on which the plate-shaped member is cantilevered.

Figure 10:
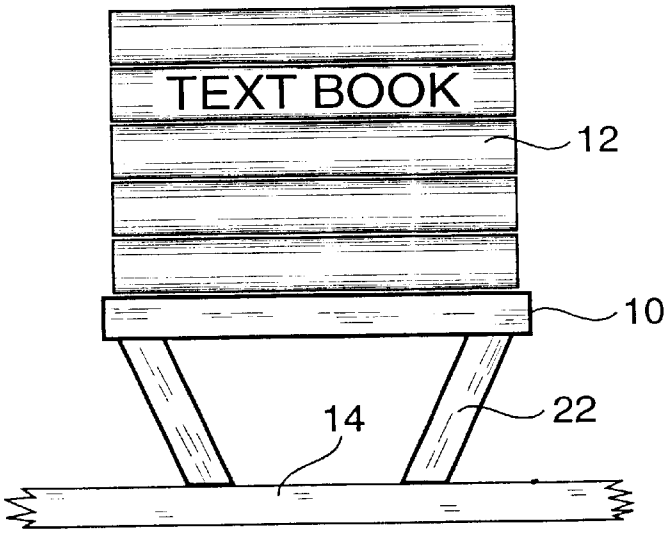
Figure 11:
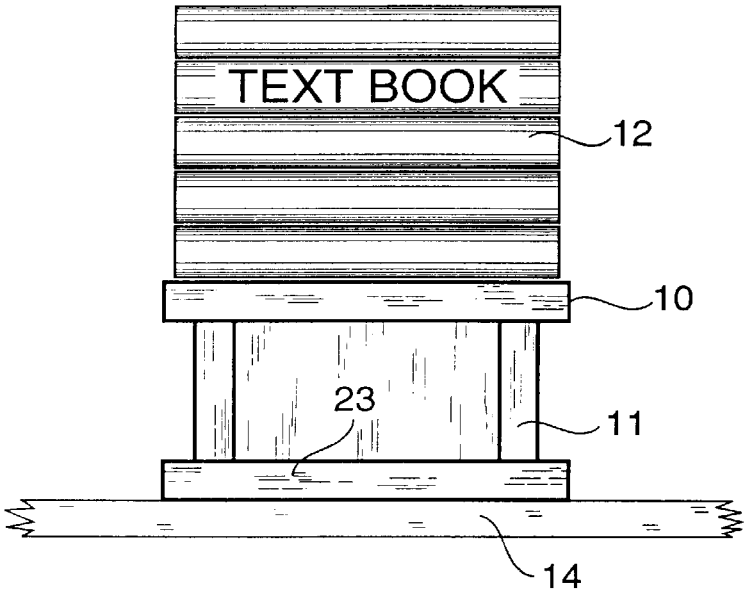

FIG. 10 is a display arrangement in which members 22 support the member 10 at an angle with respect to the member 10, and to the base member 14. Thus, whereas the members 22 form an angle that is less than 90 degrees on the inside with respect to the member 10, FIG. 8 shows the arrangement in which the supporting members 21 form an angle that is greater than 90 degrees with respect to the member 10. FIG. 11 shows an arrangement in which the members 11 are secured at their bottom ends to a plate-shaped member 23. This plate-shaped member 23 rests, in turn, on the base member 14.

Figure 12:
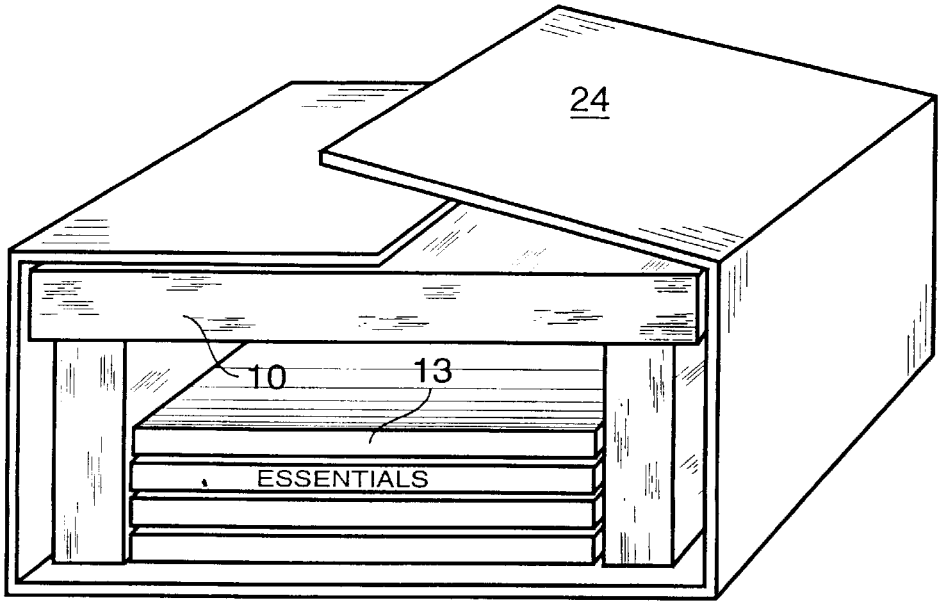
FIG. 12 is an arrangement by which the holder for the study aids may be securely shipped.

FIG. 12 is an arrangement in which a shipping container is included to wrap around the holder for the study aids for the purpose of protecting the holder during shipment together with the study aids inserted into the holder. In this manner, the recipient to whom the holder is shipped, can simply remove the wrapper around the holder, without requiring any tools or instruments to cut or remove the wrapper 24, and place the holder in the desired location with the study aids inserted into the holder prior to shipment. After removing the wrapper 24 which is simply folded about the holder, textbooks may be placed on top of the holder, as previously described.

In referring to FIG. 4, it may be seen that the members 11 and 18 are positioned inward from the outer edges of the member 10. The spacing of members 11 and 18, in this manner, on the member 10 permits greater tolerances in the fabrication and assembly of the display unit. Accordingly, the members 18 and 11 need not be precisely flush with the outer edges of the member 10, so that simplified manufacture of the display unit is made possible.

The holder for the study aids, in accordance with the present invention, furthermore, need not be any larger than the textbook itself, so that the holder occupies no more space than a textbook. This is an important feature in bookstores that have space limitations.

The structural members of the holder may be made of wood, plastics, or metal, for example. These structural members may be finished on their surfaces with a hard laminate such as formica. The back member 18, on the other hand, may remain unfinished, since it is not visible when located in place with study aids inserted and textbooks resting on the holder.

The bottom surfaces of the members 11 and 18 may either remain unfinished, or they may be finished surfaces that are smooth so as to prevent scratching of the base member on which the struts 11 rest.

Particle board may also be used for the structural members of the holder.

Booksellers are challenged on how to display the study aids with the textbooks but consume minimal additional shelf space for the study aids since the textbooks themselves require a great deal of shelf space that is often in short supply in the bookstore. A feature of the present invention is to integrate the textbooks with study aids without consuming additional shelf space for the study aids but rather use the air space above the shelf. The present invention achieves this by allowing the textbooks to be stacked above the study aids thereby taking advantage of the air space above the shelf without using additional physical shelf space.

What is claimed is:

1. An arrangement displaying study aids together with textbooks, comprising: a first supporting plate-shaped member; at least one second supporting plate-shaped member secured to said first supporting plate-member at a substantially given angle; a plurality of textbooks stacked on said first support plate-shaped member and relevant to a specific field of knowledge; a base member in contact with said second supporting plate-shaped member; and a plurality of study aids within a volume defined by said first supporting plate-shaped member, said at least one second supporting plate shaped member and said base member, said study aids being visible simultaneously with said textbooks to an onlooker when removing a textbook from said stacked textbooks.

2. The arrangement as defined in claim 1, including a sign secured to a front edge of said first supporting plate-shaped member for describing the study aids.

3. The arrangement as defined in claim 1, wherein said first supporting plate-shaped member has an area corresponding substantially to the area of a textbook.

4. The arrangement as defined in claim 1, wherein said at least one second supporting plate-shaped member has a height substantially not larger than a textbook thickness.

5. The arrangement as defined in claim 1, wherein said at least one second plate-shaped member comprises two plate-shaped members; and a third plate-shaped member between sides of said two second plate-shaped members.

6. The arrangement as defined in claim 1, including a fourth plate-shaped member secured to said second plate-shaped member and in contact with said base member.

7. The arrangement as defined in claim 1, wherein said first plate-shaped member is a cantilevered member supporting the textbooks.

8. The arrangement as defined in claim 1, wherein said given angle is substantially 90 degrees.

9. The arrangement as defined in claim 1, wherein said given angle is greater than 90 degrees.

10. The arrangement as defined in claim 1, wherein said given angle is less than 90 degrees.

11. The arrangement as defined in claim 1, wherein said first plate-shaped member and said second plate-shaped member are comprised of particle board with a hard laminate finish.

12. The arrangement as defined in claim 1, wherein said second plate-shaped member has an unfinished surface in contact with said base member.

13. The arrangement as defined in claim 1, wherein said second plate-shaped member has a finished surface in contact with said base member to prevent abrasion of said base member.

14. The arrangement as defined in claim 1, including screws for securing said first plate-shaped member to said second plate-shaped member, said at least one second plate-shaped member being located on said first plate-shaped member at a specific distance inside from outer edges of said first plate-shaped member.

15. The arrangement as defined in claim 1, wherein said first plate-shaped member is secured by adhesive means to said second plate-shaped member.

16. The arrangement as defined in claim 1, wherein said study aids are booklets summarizing the subject matter of the textbooks.

17. The arrangement as defined in claim 1, wherein said study aids comprises laminated charts summarizing the field of knowledge pertaining to the textbooks.

18. The arrangement as defined in claim 1, wherein said study aids comprise books having a thickness corresponding substantially to the thickness of the textbook.

19. The arrangement as defined in claim 1, including at least one additional stack of textbooks on said base member and adjacent to said first plate-shaped member supporting said plurality of textbooks.

20. The arrangement as defined in claim 1, including a shipping wrapper around said first plate-shaped member and said second plate-shaped member for shipment of said first plate-shaped member and said second plate-shaped member assembled together with said study aids held within said wrapper, said study aids to be placed and displayed together with said textbooks.

* * * * *